US006554650B2

(12) United States Patent
Kayworth et al.

(10) Patent No.: US 6,554,650 B2
(45) Date of Patent: Apr. 29, 2003

(54) DEVICE AND METHOD FOR SYNCHRONOUS DATA COMMUNICATIONS VIA 4-PAIR UNSHIELDED TWISTED PAIR CABLE

(76) Inventors: Andrew E. Kayworth, 3577 Red Cloud Trail, St. Augustine, FL (US) 32086; Thomas D. Morris, 1972 Red Bug Alley, Middleburg, FL (US) 32068; Robert F. Marnell, 508 Cricket Cove Ct., Orange Park, FL (US) 32073

( * ) Notice: Subject to any disclaimer, the term of this patent is extended or adjusted under 35 U.S.C. 154(b) by 0 days.

(21) Appl. No.: 09/907,803

(22) Filed: Jul. 18, 2001

(65) Prior Publication Data

US 2002/0013102 A1 Jan. 31, 2002

Related U.S. Application Data

(60) Provisional application No. 60/218,902, filed on Jul. 18, 2000.

(51) Int. Cl.[7] ..... H01R 13/625

(52) U.S. Cl. ..... 439/638; 439/323; 439/639; 439/676; 439/941

(58) Field of Search ..... 439/638, 323, 439/941, 676, 639

(56) References Cited

U.S. PATENT DOCUMENTS

| | | | | | |
|---|---|---|---|---|---|
| 6,074,255 | A | * | 6/2000 | Schultz et al. | 439/638 |
| 6,213,815 | B1 | * | 4/2001 | Wu | 439/638 |
| 6,340,313 | B1 | * | 1/2002 | Hwang | 439/638 |
| 6,439,916 | B1 | * | 8/2002 | Kuo | 439/362 |

* cited by examiner

*Primary Examiner*—P. Austin Bradley
*Assistant Examiner*—Truc Nguyen
(74) *Attorney, Agent, or Firm*—Thomas C. Saitta

(57) ABSTRACT

A connector adaptor, alone or paired with a second connector adaptor and joined by a 4-pair CAT-5 type unshielded twisted pair cable, capable of transmitting synchronous data in RS232 type format between data transmissions equipment and data communications equipment, the adaptor having an equipment interface with greater than eight active pins and an RJ45 type interface, where eight of the active pins are connected directly to the eight contacts of the RJ45 type interface and at least one of the active pins is connected directly to another of the active pins in looped or shorted manner.

6 Claims, 14 Drawing Sheets

| RJ45 FEMALE CONTACTS | | DB60 MALE CONTACTS |
|---|---|---|
| 1 | ↔ | 12 DTR |
| 2 | ↔ | 2 RC |
| 3 | ↔ | 1 RD |
| 4 | ↔ | 6 DCD |
| 5 | ↔ | 26 SG |
| 6 | ↔ | 5 TD |
| 7 | ↔ | 3 TC |
| 8 | ↔ | 7 DSR |

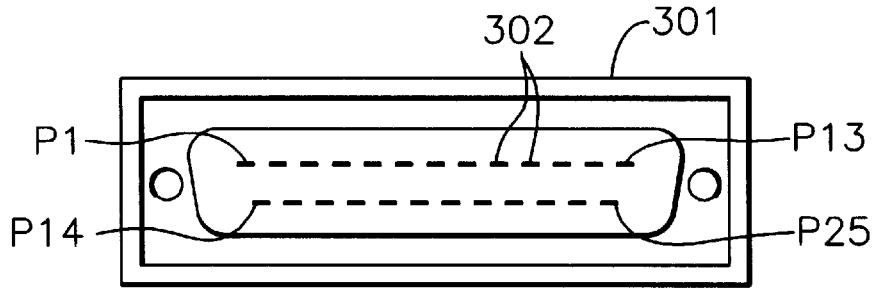
Fig. 9
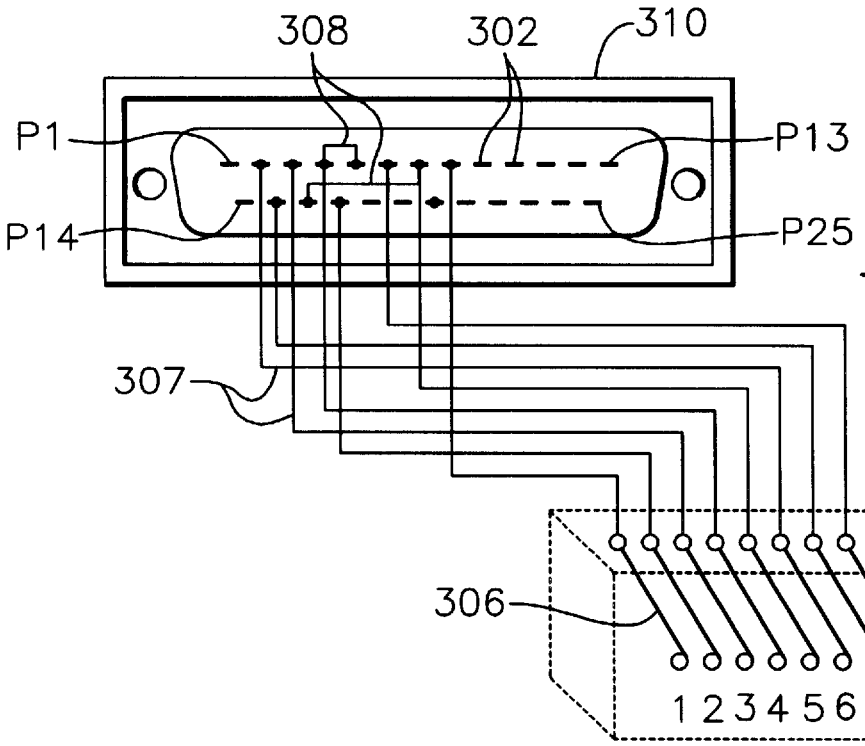
Fig. 10
| RJ45 FEMALE CONTACTS | | DB25 MALE CONTACTS |
|---|---|---|
| 1 | ↔ | 8 DCD ⌒ 20 DTR |
| 2 | ↔ | 17 RC |
| 3 | ↔ | 3 RD |
| 4 | ↔ | 4 RTS ⌒ 5 CTS |
| 5 | ↔ | 7 SG ⌒ 16 DCT |
| 6 | ↔ | 2 TD |
| 7 | ↔ | 15 TC |
| 8 | ↔ | 6 DSR |
Fig. 11

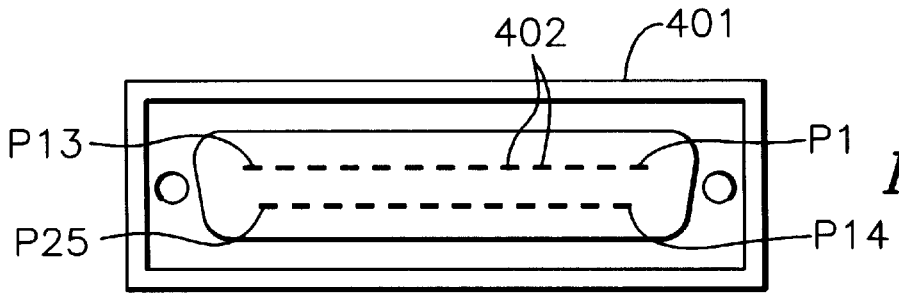
Fig. 12
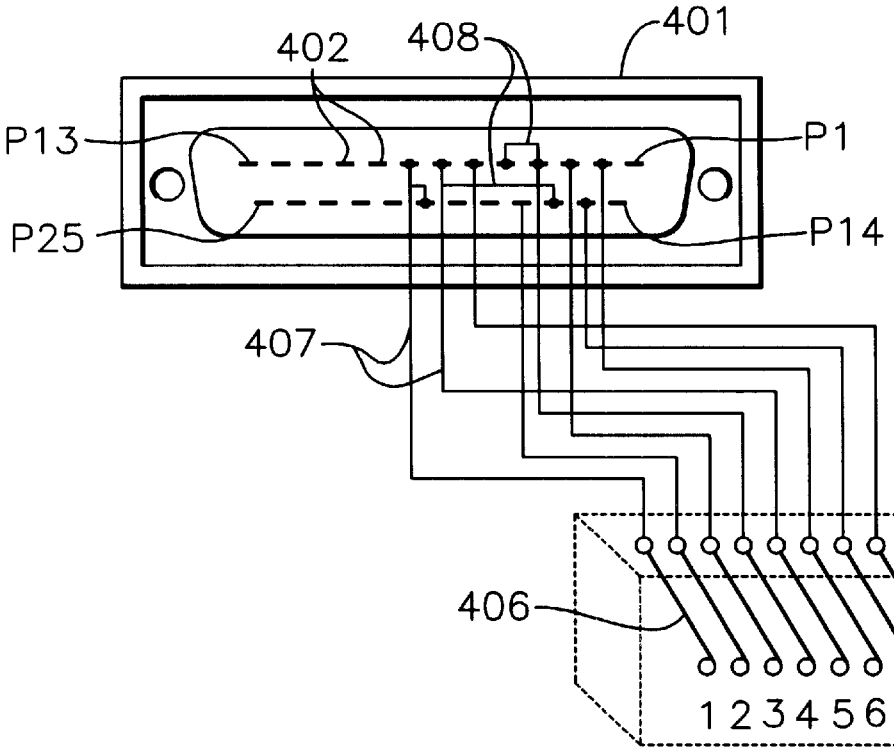
Fig. 13
| RJ45 FEMALE CONTACTS | | DB25 FEMALE CONTACTS |
|---|---|---|
| 1 | ↔ | 8 DCD ⌒ 20 DTR |
| 2 | ↔ | 17 RC |
| 3 | ↔ | 3 RD |
| 4 | ↔ | 4 RTS ⌒ 5 CTS |
| 5 | ↔ | 7 SG ⌒ 16 DCT |
| 6 | ↔ | 2 TD |
| 7 | ↔ | 15 TC |
| 8 | ↔ | 6 DSR |
Fig. 14

| RJ45 FEMALE CONTACTS | DB60 MALE CONTACTS |
|---|---|
| 1 ↔ | 12 DTR |
| 2 ↔ | 2 RC |
| 3 ↔ | 1 RD |
| 4 ↔ | 6 DCD |
| 5 ↔ | 26 SG |
| 6 ↔ | 5 TD |
| 7 ↔ | 3 TC |
| 8 ↔ | 7 DSR |

DEVICE AND METHOD FOR SYNCHRONOUS DATA COMMUNICATIONS VIA 4-PAIR UNSHIELDED TWISTED PAIR CABLE

This application claims the benefit of U.S. Provisional Application Serial No. 60/218,902, filed Jul. 18, 2000.

BACKGROUND OF THE INVENTION

The invention relates generally to the field of data communications and transmissions, and more particularly to the field of data communications involving computers, routers, controllers, modems, network devices, alarms and/or other related peripheral equipment, referred to as either Data Terminal Equipment (DTE) or Data Communications Equipment (DCE), where the invention relates most particularly to data communications accomplished via interconnection means comprising cables connected to the transmitting and receiving equipment by multi-pin adaptors, where the interconnection means allows for transmission of both data information streams and non-data signal streams, and where the data communications may involve either synchronous or asynchronous transmissions.

This invention relates to data communications related to both EIA/TIA-232 and V.35 standards. Basic EIA/TIA-232 and V.35 Serial Communications incorporate the use of multi-pin connectors and multi-pair cable. Typical EIA/TIA-232 Serial Communications standards include 25 pin data connectors to include labeling each for an assigned function. There are multiple variations in configurations. Different forms of communication require different numbers and/or combinations of pins. Asynchronous mode could include anywhere from 3 to 9 pins or Synchronous to include 11. Typical V.35 Serial Communications standards include 34 pin data connectors to include labeling for each for an assigned function. There are multiple variations in configurations. Different forms of communication require different numbers and/or combinations of pins. Typical V.35 communications utilize 17 pins. Basic V.35 communications utilizes EIA/TIA-232 standards for the first ten required signals of Data Transmission.

With the advances of technology increasing exponentially as time passes, better, faster and cheaper methods of communication are being required and developed. Typical RS-232 cable comprises a bundle of from 11 to 25 conductor wires, usually non-twisted and shielded. Because of interference or cross-talk problems within the cable itself, the usable lengths of this cable are limited to distances of less than 50 feet for high speed transmissions.

This invention will allow the older EIA/TIA-232 standard to increase its reliable distance limitation while utilizing newer, cheaper transmission media such as Category-5 Unshielded Twisted Pair (UTP) cable, thus allowing -EIA/TIA-232 to compete with newer transmission protocols or act as a reliable interim for inevitable transmission upgrades, while utilizing the same media as these new protocols. This invention will decrease overall cost to include connectors, cables and labor to approximately 50% of today's EIA/TIA-232 standards. Further benefits of both the EIA/TIA-232 and V.35 models allows users to utilize 4-pair data patch panels for quick installation and de-installation, while reducing the amount of space required for proper cable management.

It is an object of this invention to provide interface adaptors for DTE and DCE which will enable Synchronous and Asynchronous data transmissions now requiring interfaces having greater than 8 active leads, pins or contacts for data and signal transmission to be transmitted over 4-pair Category-5 UTP cable, where the adaptors are constructed such that non-data stream leads are combined in a manner which allows proper delivery of all such non-data stream leads over 8 or less wires within the 4-pair Category-5 UTP cable, both in terms of signal content and sequence, such that data and signal communications are not compromised. It is an object to provide such adaptors having a standard female 8-pin or contact interface (RJ-45) for mating with a standard patch cord male 8-pin or contact interface and an opposing interface corresponding in configuration (male or female, as well as overall shape and size) and in the number of pins or contacts (e.g., 25, 26, 50, 60) to standard computer equipment interfaces and patch panels. It is an object to provide a system using such adaptors where positive voltage from the DTE ready signal (DTR) is used to provide the necessary positive voltage on leads required for the start-up sequence in RS232 signaling by selectively electrically connecting these leads together in the adapter. It is an object to provide a system where the 4-pair CAT-5 UTP cable carries RS232 Synchronous data signals, such that the primary leads for V.35 data signals are based on RS232 type signaling protocols (i.e., +3V and −3V).

SUMMARY OF THE INVENTION

The present invention provides a means to transport Serial Data Communications across 4-Pair of Unshielded Twisted Pair Cable in accordance with EIA/TIA-232 or V.35 Serial Communications standards. The ten V.35 signals manipulated to run over 4-pair are transmitting signals in accordance with EIA/TIA-232 Standards. Any other signals not correlating to EIA/TIA-232 Standards are not utilized in this invention. The interface connector adaptors of the invention utilize eight pin RJ45 metallic based contacts for use with RJ45 male end connectors, a prefabricated petroleum based enclosure, screw-type fasteners and insulated metallic-based or molded circuit board type conductors for connection between RJ45 conductors and Serial Connectors. Specific pin-outs for each connector adaptor are determined by the particular equipment interface of the computer communications equipment. Positive voltage from the DTE signal is used to provide the necessary positive voltage on leads required for the start up sequence in RS232 signaling by selectively electrically connecting these leads together in the adaptor.

The connector adaptor designated herein as an ADA-DB60MC-GM connector transports eight required (+3V, −3V) RS232 signals from a DB60 connector interface to a female RJ45 connector interface. Two additional required signals are looped back within the DB60 connector interface. The RJ45 connector interface is a standard 8-pin plug receptacle and the wires are soldered to the specified DB60 pins within the DB60 connector interface. This Pinout is designed to support DCE such as 3×74 controllers and SDLC Automatic Teller Machines. This connector also supports a direct RJ45 connection to the ADT Focus panel. A standard CAT5 cable or patch cord can be connected to this connector to extend these signals to recommended lengths of 492 feet @19.2Kbs. Distances of over 700 feet have been tested in a lab environment @19.2Kbs.

The connector adaptor designated as an ADA-DB60MT-GM connector transports eight required (+3V,. −3V) RS232 signals from a DB60 connector interface to a female RJ45 connector interface. Three additional required signals are looped back within the DB60 Connector. The RJ45 connector interface is a standard 8-pin plug receptacle and the wires are soldered to the specified DB60 pins within the DB60 connector interface. This Pinout is designed to support DTE such as analog modems or a DSU used for a tail circuit. Four signals are reversed in comparison to the ADA-DB60MC-GM connector. A standard CAT5 cable or patch cord can be connected to this connector to extend these signals to recommended lengths of 492 feet @19.2Kbs. Distances of over 700 feet have been tested in a lab environment @19.2Kbs.

The connector adaptors designated as ADA-232M-GM and ADA-232F-GM connectors convert eight required (+3V, −3V) RS232 signals from a DB25 connector to a female RJ45 connector. These 8 leads are soldered to the specific DB25 pins. This Pinout is designed to be used with the ADA-DB60MT-GM and ADA-DB60MT-GM connectors. The Pin-out is identical between the ADA-232M-GM and ADA232F-GM. The M designates a Male connector typically used with DTE equipment and the F designates a Female connector typically used with DCE equipment.

The connector adaptor designated as an ADA-DB60V35MC-GM connector converts eight required (+3V, −3V) V.35 signals from a DB60 connector to a female RJ45 connector. Two additional required signals are looped back within the DB60 Connector. The RJ45 connector is a standard 8-pin plug and the wires are soldered to the specified DB60 pins. This Pin-out is designed to support DCE equipment in a back-to-back mode with DTE equipment. A standard CAT5 cable or patch cord can be connected to this connector to extend these signals to approximately 21 feet at 4 Mbs and 40 feet at 800 Kbs.

The connector adaptor designated as an ADA-DB60V35MT-GM connector converts eight required (+3V, −3V) V.35 signals from a DB60 connector to a female RJ45 connector. The RJ45 connector is a standard 8-pin plug and the wires are soldered to the specified DB60 pins. This Pin-out is designed to support DTE equipment in a back-to-back mode with DCE equipment. A standard CAT5 cable or patch cord can be connected to this connector to extend these signals to approximately 21 feet at 4 Mbs and 40 feet at 800 Kbs.

The connector adaptor designated as an ADA-DBSSRS232MC-GM connector converts eight required (+3V, −3V) RS232 signals from the DBSS connector to a female RJ45 connector. Two additional required signals are looped back within the DBSS Connector. The RJ45 connector is a standard 8-pin plug and the wires are soldered to the specified DBSS pins. This Pin-out is designed to support DCE equipment such as 3×74 controllers and SDLC Automatic Teller Machines. This connector also supports a direct RJ45 connection to the ADT Focus panel. A standard CAT5 cable or patch cord can be connected to this connector to extend these signals to recommended lengths of 492 feet @19.2Kbs. Distances of over 700 feet have been tested in a lab environment @19.2Kbs.

The connector adaptor designated as an ADA-DBSSRS232MT-GM connector converts eight required (+3V, −3V) RS232 signals from a DBSS connector to a female RJ45 connector. Three additional required signals are looped back within the DBSS Connector. The RJ45 connector is a standard 8-pin plug and the wires are soldered to the specified DBSS pins. This Pin-out is designed to support DTE equipment such as analog modems or a DSU used for a tail circuit. A standard CAT5 cable or patch cord can be connected to this connector to extend these signals to recommended lengths of 492 feet @19.2Kbs. Distances of over 700 feet have been tested in a lab environment @19.2Kbs.

The connector adaptor designated as an ADA-DBSSV35MC-GM connector converts eight required (+3V, −3V) V.35 signals from a DBSS connector to a female RJ45 connector. Two additional required signals are looped back within the DBSS Connector. The RJ45 connector is a standard 8-pin plug and the wires are soldered to the specified DBSS pins. This Pin-out is designed to support DCE equipment in a back-to-back mode with DTE equipment. A standard CAT5 cable or patch cord can be connected to this connector to extend these signals to approximately 21 feet at 4 Mbs and 40 feet at 800 Kbs.

The connector adaptor designated as an ADA-DBSSV35MT-GM connector converts eight required (+3V, −3V) V.35 signals from the DBSS connector to a female RJ45 connector. The RJ45 connector is a standard 8-pin plug and the wires are soldered to the specified DBSS pins. This Pin-out is designed to support DTE equipment in a back-to-back mode with DCE equipment. A standard CAT5 cable or patch cord can be connected to this connector to extend these signals to approximately 21 feet at 4 Mbs and 40 feet at 800 Kbs.

The connector adaptor designated as an ADA-DB50V35MC-GM connector converts eight required (+3V, −3V) V.35 signals from the DB50 connector to a female RJ45 connector. Two additional required signals are looped back within the DB50 Connector. The RJ45 connector is a standard 8-pin plug and the wires are soldered to the specified DB50 pins. This Pin-out is designed to support DCE equipment in a back-to-back mode with DTE equipment. A standard CAT5 cable or patch cord can be connected to this connector to extend these signals to approximately 21 feet at 4 Mbs and 40 feet at 800 Kbs.

BRIEF DESCRIPTION OF THE DRAWINGS

FIG. 9 is a front view of a third embodiment of the invention designated as an ADA-232M-GM connector for DCE showing an interface equivalent to an EIA/TIA-232 standard 25 pin male connector and surrounding enclosure.

FIG. 10 is an internal wiring diagram of the connector adaptor of FIG. 9 showing the eight pin RJ45 internal leads connected to the 25 pin interface.

FIG. 11 is a Pinout diagram showing the designated signals as carried by the connections and loops of the wiring diagram of FIG. 10.

FIG. 12 is a front view of a fourth embodiment of the invention designated as an ADA-232F-GM connector for DCE showing an interface equivalent to an EIA/TIA-232 standard 25 pin female connector and surrounding enclosure.

FIG. 13 is an internal wiring diagram of the connector adaptor of FIG. 12 showing the eight pin RJ45 internal leads connected to the 25 pin interface.

FIG. 14 is a Pinout diagram showing the designated signals as carried by the connections and loops of the wiring diagram of FIG. 13.

DETAILED DESCRIPTION OF THE INVENTION

Figure 1:
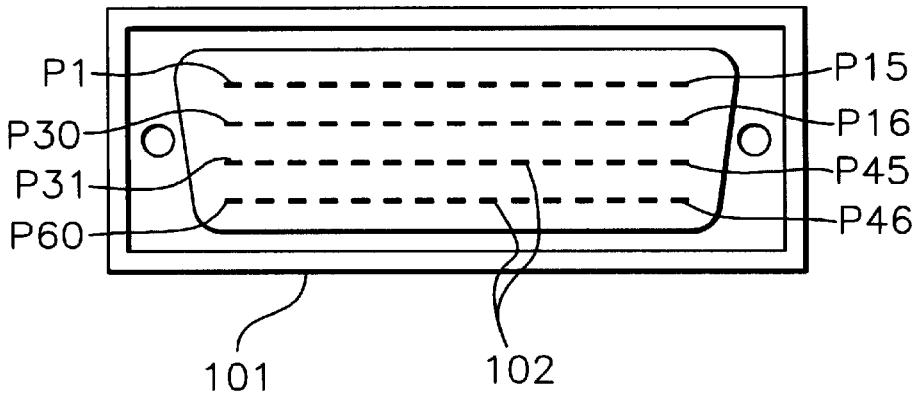
FIG. 1 is a front view of a first embodiment of the invention designated as an ADA-DB60MC-GM connector for DCE showing an interface equivalent to a Cisco Systems 60 pin Molex adapter and surrounding enclosure.

With reference to the drawings, the invention will be described in detail with regard for the best mode and the preferred embodiments. In general, the invention comprises connector adaptors and a method of utilizing such adaptors to transport Serial Data Communications, either Synchronous or Asynchronous, across 4-Pair of Unshielded Twisted Pair Cable in accordance with EIA/TIA-232 or V.35 Serial Communications standards. The invention allows transmission of Serial Data Communications over a total of eight leads between Data Transmission Equipment (DTE) and Data Communications Equipment (DCE) where normally more than eight leads are utilized, wherein specific non-data leads are linked such that the proper non-data signals are still received in proper sequence.

In RS232 signaling, the pins or leads of the DTE are assigned to carry specific signals. Pin 2 of the DTE is the Transmit Data (TD) pin carrying data to the DCE. Pin 3 is the Receive Data (RD) pin and accepts data from the DCE. Pin 4 is the Request To Send (RTS) pin. When voltage is present this signals that the receive buffer on the DTE is empty and is asking the DCE to send more data. Pin 5 is the Clear To Send (CTS) pin and when voltage is present indicates that the buffers in the DCE are empty and ready to receive more data. Pins 4 and 5 handle flow control. Pin 6 is the Data Set Ready (DSR) pin and when a voltage is present indicates that the DCE is ready. Pin 7 is ground, and is a reference point for the other signals. Pin 8 is the Carrier Detect (CD) pin, which indicates DCE ready. Pin 20 is the Data Terminal Ready (DTR) pin, which indicates DTE ready.

In order to utilize the proper connector adaptor configuration, the equipment is examined to determine the necessary equipment interfaces for the DTE and DCE communication cable. For example, the standard interfaces are typically either a Cisco Systems 60 pin Molex type, an EIA/TIA-232 standard 25 pin type, a Smart Serial 26 pin, or a 50 pin type. Location and arrangement of pins, and whether male or female interfaces are required, are determined by the DTE and DCE equipment. The equipment interface of the connector adaptor is chosen to mate.

The operative or active pins of the equipment interface on the adaptor are connected either directly to the pins of an RJ45 interface or are linked together in a manner such that a signal voltage directed to the linked pins is received by both, and this may be accomplished by standard known means such as hard-wiring or by use of a circuit board. Non-data signals are linked such that data transmission normally requiring more than 8 active pins, i.e. Synchronous data transmission, is accomplished through only 8 active pins. In this manner the number of necessary leads or lines within the communication cable is reduced to eight. To determine the proper pins to be linked, the core signals are isolated and the purpose of all signals is determined. The signal leads or pins carrying non-data streams are then linked in a manner which allows the non-data signals to be delivered and received in proper form and sequence by the DTE and DCE. Thus, in a data communications situation which normally requires greater than 8 pins, the adaptor provides the same communication with only 8 pins, the data being transmitted over a 4-pair (8 wire) unshielded twisted pair cable.

The following embodiments show particular configurations as required by particular equipment interfaces and signaling protocols.

Figure 2:
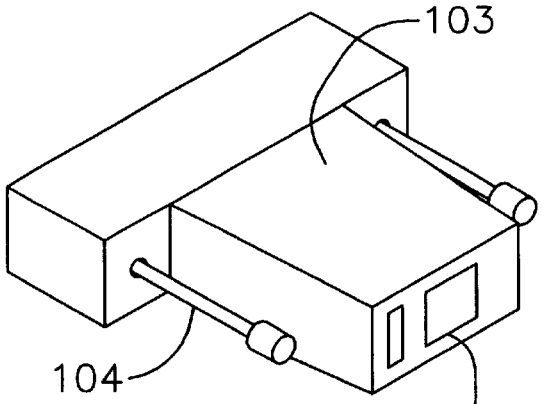
FIG. 2 is a perspective view of the connector enclosure of FIG. 1 showing a female RJ45 connection and left screw-type fastener.
Figure 3:
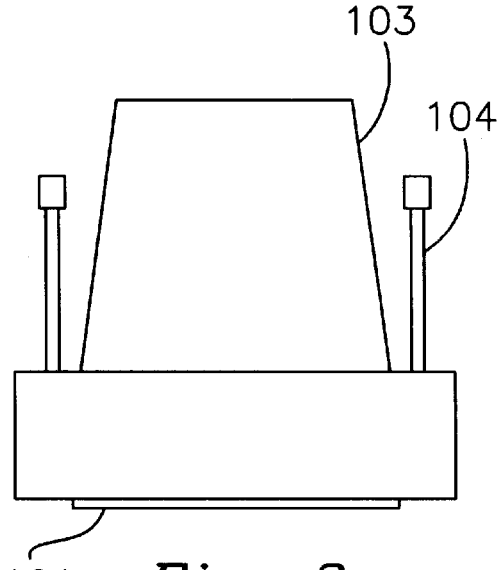
FIG. 3 is a top view of the enclosure of FIG. 1 depicting both screw-type fasteners.
Figure 4:
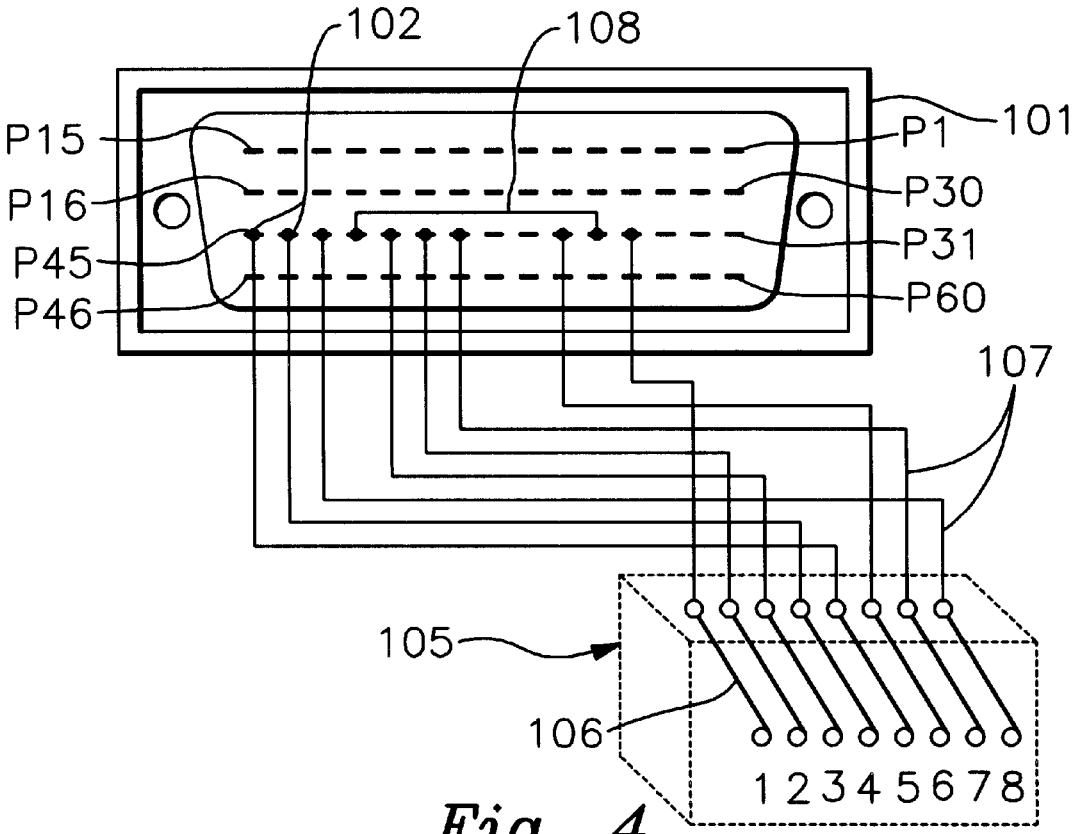
FIG. 4 is an internal wiring diagram of the connector adaptor of FIG. 1 showing the eight pin RJ45 internal leads connected to the 60 pin interface.
Figure 5:
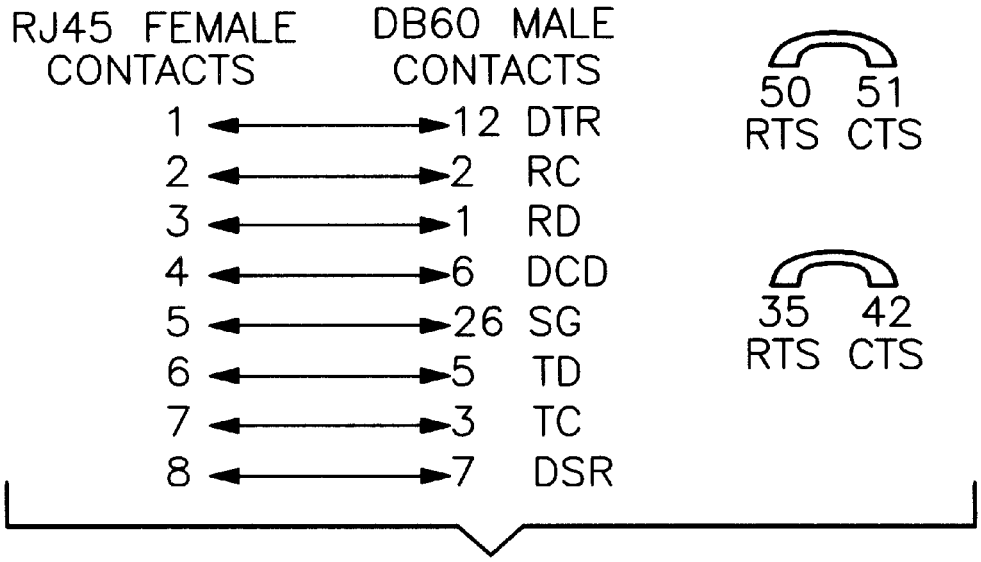
FIG. 5 is a Pinout diagram showing the designated signals as carried by the connections and loops of the wiring diagram of FIG. 4.

FIGS. 1 through 5 show an embodiment designated herein as ADA-DB60MC-GM, which has an equipment interface 101 with 60 contacts or pins 102 equivalent to a 60 pin Male Molex adapter utilized by Cisco Systems, which interface is electrically connected to a RJ45 Female Connector, and is for use with DCE. FIG. 1 shows the 60 pin equipment interface 101 used to mate with the interface on the DCE. FIGS. 2 and 3 show a standard housing 103 for the adaptor with standard screw type fasteners 104. FIG. 4 illustrates a wiring diagram for this embodiment, where the RJ45 connector interface 105 comprises metallic contacts 106 pointing downward, metallic insulated conductors or leads 107, which could alternatively comprise a circuit board, joined in electrical communication to the internal soldering contact points of the pins 102 of the equipment interface 101. As viewed the contacts are numbered from left to right, one through eight, with one being the far left contact, and eight being the far right contact, all in accordance with 4-pair Unshielded Twisted Pair cabling standards.

Pins 1–32, 36, 37, 46–49 and 52–60 of this equipment interface 101 are not used. The Pinouts for this embodiment are shown in both FIG. 4 and FIG. 5. Pins 50 and 51 are shorted to signify DCE, i.e., linked directly to each other, via conductive material or wiring 108. Pins 35 for Request to Send (RTS) signal and 42 for Clear to Send (CTS) signal are shorted together as well.

Contact one of RJ45 female connector 105 is connected to pin 34 of equipment interface 101 for Data Terminal Ready (DTR) signal exchange. Contact two is connected to pin 40 of equipment interface 101 for Receive Clock (RC) signal exchange. Contact three is connected to pin 41 of equipment interface 101 for Receive Data (RD) signal exchange. Contact four is connected to pin 44 of equipment interface 101 for Data Carrier Detect (DCD) signal exchange. Contact five is connected to pin 45 of equipment interface 101 for Signal Ground (SG) signal exchange. Contact six is connected to pin 36 of equipment interface 101 for Transmit Data (TD) signal exchange. Contact seven is connected to pin 39 of equipment interface 101 for Transmit Clock (TC) signal exchange. Contact eight is connected to pin 43 of equipment interface 101 for Data Source Ready (DSR) signal exchange.

Figure 6:
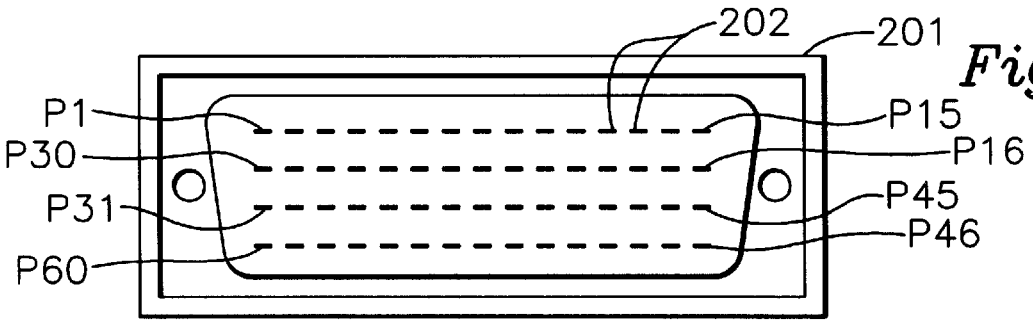
FIG. 6 is a front view of a second embodiment of the invention designated as an ADA-DB60MT-GM connector for DTE showing an interface equivalent to a Cisco Systems 60 pin Molex adapter and surrounding enclosure.
Figure 7:
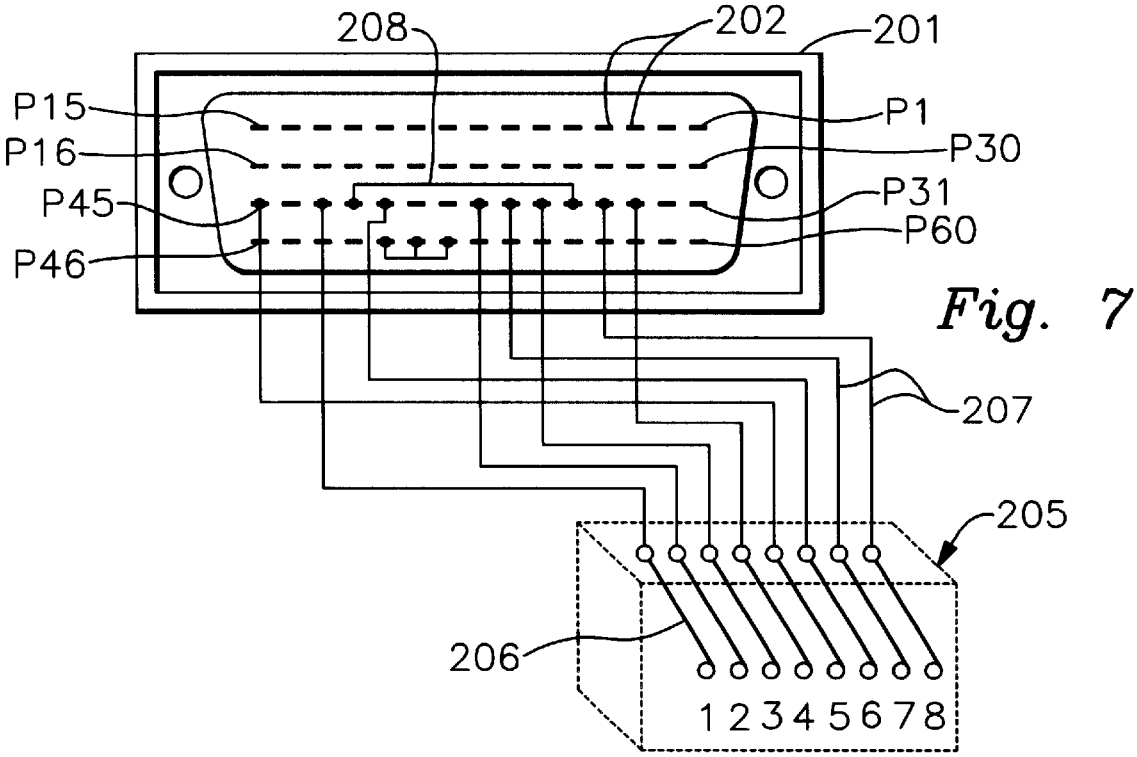
FIG. 7 is an internal wiring diagram of the connector adaptor of FIG. 6 showing the eight pin RJ45 internal leads connected to the 60 pin interface.
Figure 8:
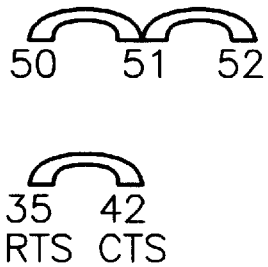
FIG. 8 is a Pinout diagram showing the designated signals as carried by the connections and loops of the wiring diagram of FIG. 7.

FIGS. 6 through 8 show an alternative embodiment designated herein as ADA-DB60MT-GM, which has an equipment interface 201 with 60 contacts or pins 202 equivalent to a 60 pin Male Molex adapter utilized by Cisco Systems, which interface is connected to a RJ45 Female Connector, and is for use with DTE. FIG. 6 shows the 60 pin equipment interface 201 used to mate with the interface on the DTE. FIG. 7 illustrates a wiring diagram for this embodiment, where the RJ45 connector interface 205 comprises metallic contacts 206, metallic insulated conductors 207 joined in electrical communication to the internal soldering contact points of pins 202 of the equipment interface 201. As viewed the contacts are numbered from left to right, one through eight, with one being the far left contact, and eight being the far right contact, all in accordance with 4-pair Unshielded Twisted Pair cabling standards.

Pins 1–32, 40, 44, 46–49 and 53–60 of this equipment interface 201 are not used. The Pinouts for this embodiment are shown in both FIG. 7 and FIG. 8. Pins 50, 51 and 52 are shorted to signify DTE, i.e., linked directly to each other, via conductive material or wiring 208. Pins 35 for Request to Send (RTS) signal and 42 for Clear to Send (CTS) signal are shorted together as well.

Contact one of RJ45 female connector 105 is connected to pin 43 of equipment interface 201 for Data Terminal Ready (DTR) signal exchange. Contact two is connected to pin 38 of equipment interface 201 for Receive Clock (RC) signal exchange. Contact three is connected to pin 36 of equipment interface 201 for Receive Data (RD) signal exchange. Contact four is connected to pin 33 of equipment interface 201 for Data Carrier Detect (DCD) signal exchange. Contact five is connected to pin 45 of equipment interface 201 for Signal Ground (SG) signal exchange. Contact six is connected to pin 41 of equipment interface 201 for Transmit Data (TD) signal exchange. Contact seven is connected to pin 37 of equipment interface 201 for Transmit Clock (TC) signal exchange. Contact eight is connected to pin 34 of equipment interface 201 for Data Source Ready (DSR) signal exchange.

FIGS. 9 through 11 show an alternative embodiment designated herein as ADA-232M-GM, which has an equipment interface 301 with 25 contacts or pins 302 equivalent to an EIA/TIA-232 Standard 25 Pin Male Connector, which interface is connected to a RJ45 Female Connector, and is for use with DCE. FIG. 9 shows the 25 pin equipment interface 301 used to mate with the interface on the DCE. FIG. 10 illustrates a wiring diagram for this embodiment, where the RJ45 connector interface 305 comprises metallic contacts 306, metallic insulated conductors 307 joined in electrical communication to the internal soldering contact points of pins 302 of the equipment interface 301. As viewed the contacts are numbered from left to right, one through eight, with one being the far left contact, and eight being the far right contact, all in accordance with 4-pair Unshielded Twisted Pair cabling standards.

Pins 1, 9–14, 16, 18, 19 and 21–25 of this equipment interface 301 are not used. The Pinouts for this embodiment are shown in both FIG. 10 and FIG. 11. Pins 8 for Data Carrier Detect (DCD) and 20 for Data Terminal Ready (DTR) signal are shorted, i.e., linked directly to each other, via conductive material or wiring 308. Pins 7 for Signal Ground (SG) and 16 for Secondary Receive Data (SRD) signal are linked together. Pins 4 for Request to Send (RTS) signal and 5 for Clear to Send (CTS) signal are shorted together as well.

Contact one of RJ45 female connector 305 is connected to pin 20 of equipment interface 301 for Data Terminal Ready (DTR) signal exchange. Contact two is connected to pin 17 of equipment interface 301 for Receive Clock (RC) signal exchange. Contact three is connected to pin 3 of equipment interface 301 for Receive Data (RD) signal exchange. Contact four is connected to pin 4 of equipment interface 301 for Request To Send (RTS) signal exchange. Contact five is connected to pin 7 of equipment interface 301 for Signal Ground (SG) signal exchange. Contact six is connected to pin 2 of equipment interface 301 for Transmit Data (TD) signal exchange. Contact s even is connected to pin 15 of equipment interface 301 for Transmit Clock (TC) signal exchange. Contact eight is connected to pin 6 of equipment interface 301 for Data Source Ready (DSR) signal exchange.

FIGS. 12 through 14 show an alternative embodiment designated herein as ADA-232F-GM, which has an equipment interface 401 with 25 contacts or pins 402 equivalent to an EIA/TIA-232 Standard 25 Pin Female Connector, which interface is connected to a RJ45 Female Connector, and is for use with DTE. FIG. 12 shows the 25 pin equipment interface 401 used to mate with the interface on the DTE. FIG. 13 illustrates a wiring diagram for this embodiment, where the RJ45 connector interface 405 comprises metallic contacts 406, metallic insulated conductors 407 joined in electrical communication to the internal soldering contact points of pins 402 of the equipment interface 401. As viewed the contacts are numbered from left to right, one through eight, with one being the far left contact, and eight being the far right contact, all in accordance with 4-pair Unshielded Twisted Pair cabling standards.

Pins 1, 9–14, 16, 18, 19 and 21–25 of this equipment interface 401 are not used. The Pinouts for this embodiment are shown in both FIG. 10 and FIG. 11. Pins 8 for Data Carrier Detect (DCD) and 20 for Data Terminal Ready (DTR) signal are shorted, i.e., linked directly to each other, via conductive material or wiring 408. Pins 7 for Signal Ground (SG) and 16 for Secondary Receive Data (SRD) signal are linked together. Pins 4 for Request to Send (RTS) signal and 5 for Clear to Send (CTS) signal are shorted together as well.

Contact one of RJ45 female connector 305 is connected to pin 20 of equipment interface 401 for Data Terminal Ready (DTR) signal exchange. Contact two is connected to pin 17 of equipment interface 401 for Receive Clock (RC) signal exchange. Contact three is connected to pin 3 of equipment interface 401 for Receive Data (RD) signal exchange. Contact four is connected to pin 4 of equipment interface 401 for Request To Send (RTS) signal exchange. Contact five is connected to pin 7 of equipment interface 401 for Signal Ground (SG) signal exchange. Contact six is connected to pin 2 of equipment interface 401 for Transmit Data (TD) signal exchange. Contact seven is connected to pin 15 of equipment interface 401 for Transmit Clock (TC) signal exchange. Contact eight is connected to pin 6 of equipment interface 401 for Data Source Ready (DSR) signal exchange.

Figure 15:
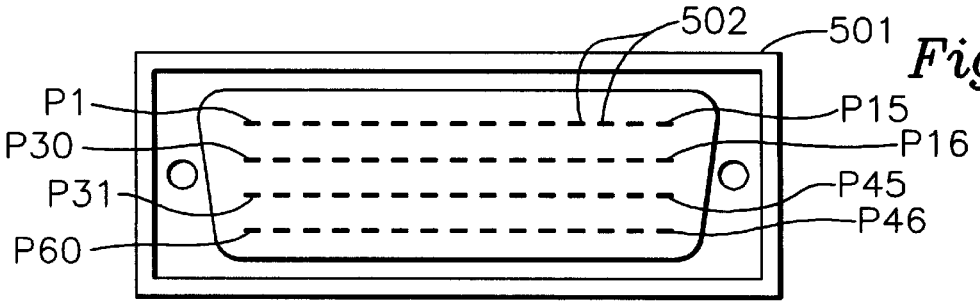
FIG. 15 is a front view of a fifth embodiment of the invention designated as an ADA-DB60V35MC-GM connector for DCE showing an interface equivalent to a Cisco Systems 60 pin Molex adapter and surrounding enclosure.
Figure 16:
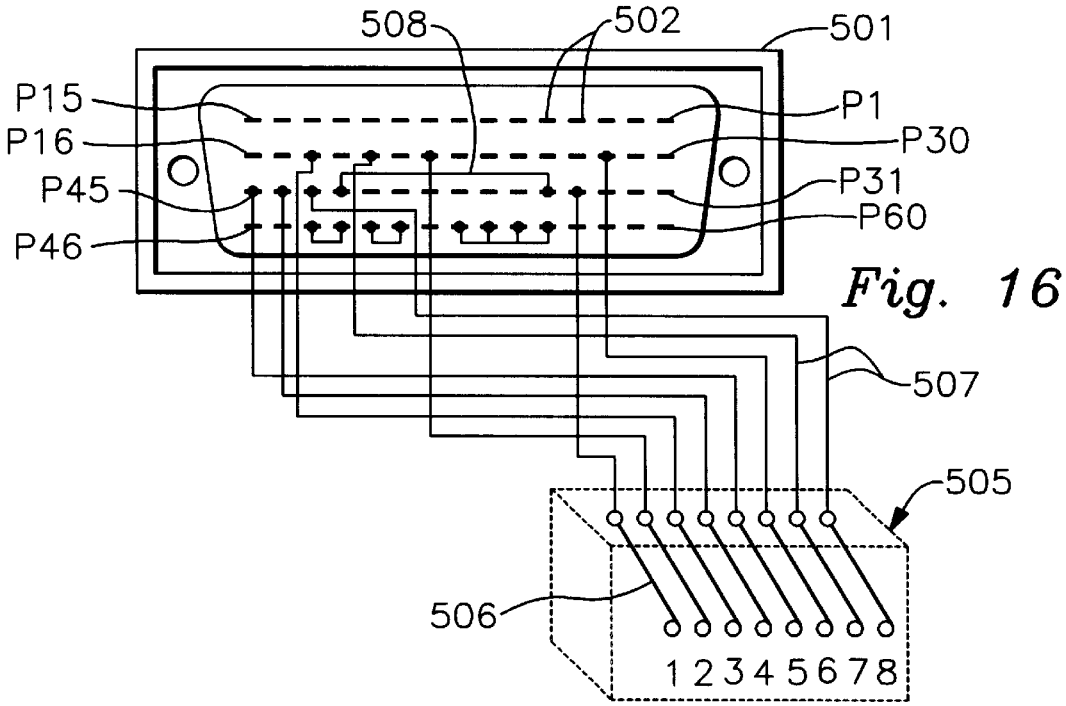
FIG. 16 is an internal wiring diagram of the connector adaptor of FIG. 15 showing the eight pin RJ45 internal leads connected to the 60 pin interface.
Figure 17:
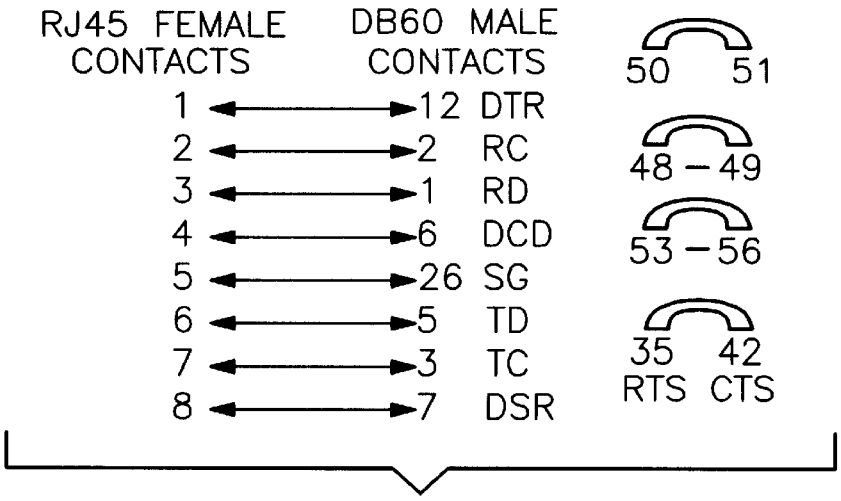
FIG. 17 is a Pinout diagram showing the designated signals as carried by the connections and loops of the wiring diagram of FIG. 16.

FIGS. 15 through 17 show an alternative embodiment designated herein as ADA-DB60V35MC-GM, which has an equipment interface 501 with 60 contacts or pins 502 equivalent to a 60 pin Male Molex adapter utilized by Cisco Systems, which interface is connected to a RJ45 Female Connector, and is for use with DCE. FIG. 15 shows the 60 pin equipment interface 501 used to mate with the interface on the DCE. FIG. 16 illustrates a wiring diagram for this embodiment, where the RJ45 connector interface 505 comprises metallic contacts 506, metallic insulated conductors 507 joined in electrical communication to the internal soldering contact points of pins 502 of the equipment interface 501. As viewed the contacts are numbered from left to right, one through eight, with one being the far left contact, and eight being the far right contact, all in accordance with 4-pair Unshielded Twisted Pair cabling standards.

Pins 1–17, 19, 21, 23–27, 29–33, 36–41, 46, 47, 52 and 57–60 of this equipment interface 501 are not used. The Pinouts for this embodiment are shown in both FIG. 16 and FIG. 17. Pins 50 and 51 are shorted to signify DCE, i.e., linked directly to each other, via conductive material or wiring 508. Pins 48 and 49 are linked to indicate V.35 signals. Pins 53, 54, 55 and 56 are linked for zero voltage over secondary data and clocking leads. Pins 35 for Request to Send (RTS) signal and 42 for Clear to Send (CTS) signal are shorted together as well.

Contact one of RJ45 female connector 505 is connected to pin 34 of equipment interface 501 for Data Terminal Ready (DTR) signal exchange. Contact two is connected to pin 22 of equipment interface 501 for Receive Clock (RC) signal exchange. Contact three is connected to pin 18 of equipment interface 501 for Receive Data (RD) signal exchange. Contact four is connected to pin 44 of equipment interface 501 for Data Carrier Detect (DCD) signal exchange. Contact five is connected to pin 45 of equipment interface 501 for Signal Ground (SG) signal exchange. Contact six is connected to pin 28 of equipment interface 501 for Transmit Data (TD) signal exchange. Contact seven is connected to pin 20 of equipment interface 501 for Transmit Clock (TC) signal exchange. Contact eight is connected to pin 43 of equipment interface 501 for Data Source Ready (DSR) signal exchange.

Figure 18:
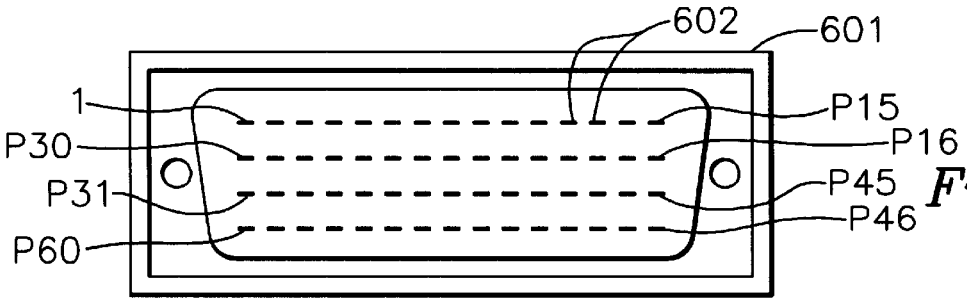
FIG. 18 is a front view of a sixth embodiment of the invention designated as an ADA-DB60V35MT-GM connector for DTE showing an interface equivalent to a Cisco Systems 60 pin Molex adapter and surrounding enclosure.
Figure 19:
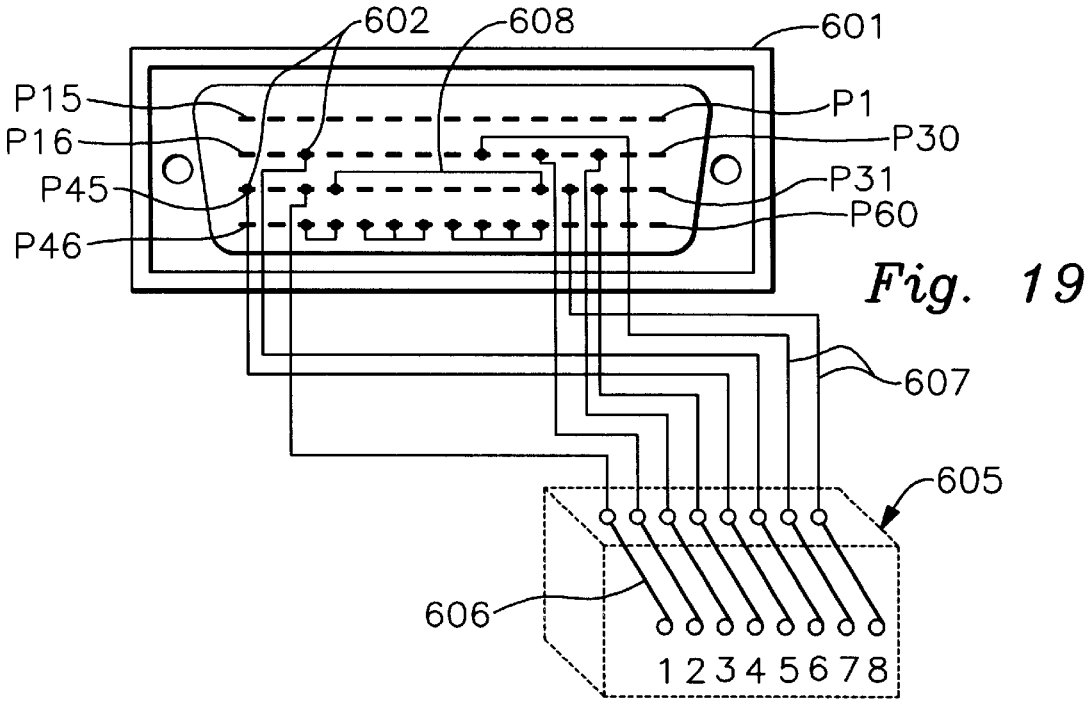
FIG. 19 is an internal wiring diagram of the connector adaptor of FIG. 18 showing the eight pin RJ45 internal leads connected to the 60 pin interface.
Figure 20:
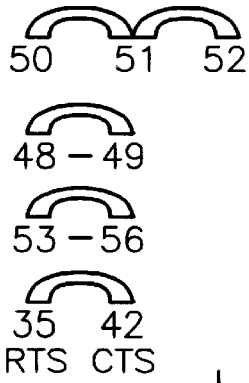
FIG. 20 is a Pinout diagram showing the designated signals as carried by the connections and loops of the wiring diagram of FIG. 19.

FIGS. 18 through 20 show an alternative embodiment designated herein as ADA-DB60V35MT-GM, which has an equipment interface 601 with 60 contacts or pins 602 equivalent to a 60 pin Male Molex adapter utilized by Cisco Systems, which interface is connected to a RJ45 Female Connector, and is for use with DTE. FIG. 18 shows the 60 pin equipment interface 601 used to mate with the interface on the DTE. FIG. 19 illustrates a wiring diagram for this embodiment, where the RJ45 connector interface 605 comprises metallic contacts 606, metallic insulated conductors 607 joined in electrical communication to the internal soldering contact points of pins 602 of the equipment interface 601. As viewed the contacts are numbered from left to right, one through eight, with one being the far left contact, and eight being the far right contact, all in accordance with 4-pair Unshielded Twisted Pair cabling standards.

Pins 1–17, 19–23, 25, 27, 29–32, 36–41, 44, 46, 47, and 57–60 of this equipment interface 601 are not used. The Pinouts for this embodiment are shown in both FIG. 19 and FIG. 20. Pins 50, 51 and 52 are shorted to indicate DTE, i.e., linked directly to each other, via conductive material or wiring 508. Pins 48 and 49 are linked to indicate V.35 signaling. Pins 53, 54, 55 and 56 are linked to place zero voltage on unnecessary secondary V.35 signals. Pins 35 for Request to Send (RTS) signal and 42 for Clear to Send (CTS) signal are shorted together as well.

Contact one of RJ45 female connector 605 is connected to pin 43 of equipment interface 601 for Data Terminal Ready (DTR) signal exchange. Contact two is connected to pin 26 of equipment interface 601 for Receive Clock (RC) signal exchange. Contact three is connected to pin 28 of equipment interface 601 for Receive Data (RD) signal exchange. Contact four is connected to pin 33 of equipment interface 601 for Data Carrier Detect (DCD) signal exchange. Contact five is connected to pin 45 of equipment interface 601 for Signal Ground (SG) signal exchange. Contact six is connected to pin 18 of equipment interface 601 for Transmit Data (TD) signal exchange. Contact seven is connected to pin 24 of equipment interface 601 for Transmit Clock (TC) signal exchange. Contact eight is connected to pin 34 of equipment interface 601 for Data Source Ready (DSR) signal exchange.

Figure 21:
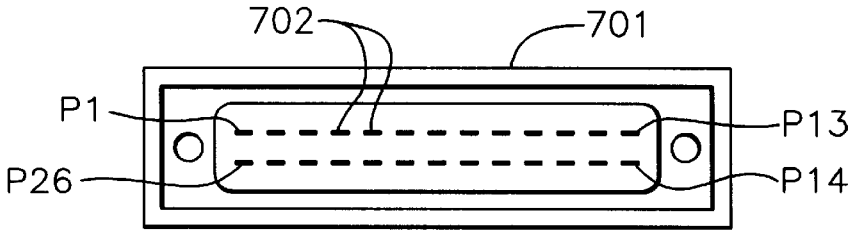
FIG. 21 is a front view of a seventh embodiment of the invention designated as an ADA-DBSSRS232MC-GM connector for DCE showing an interface equivalent to a Smart Serial 26 pin male connector and surrounding enclosure.
Figure 22:
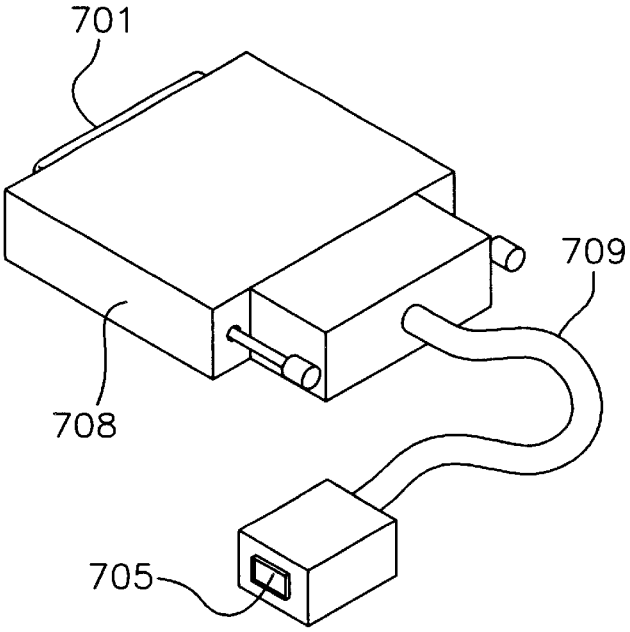
FIG. 22 is a perspective view of the connector enclosure of FIG. 21 showing a female RJ45 connection and left screw-type fastener.
Figure 23:
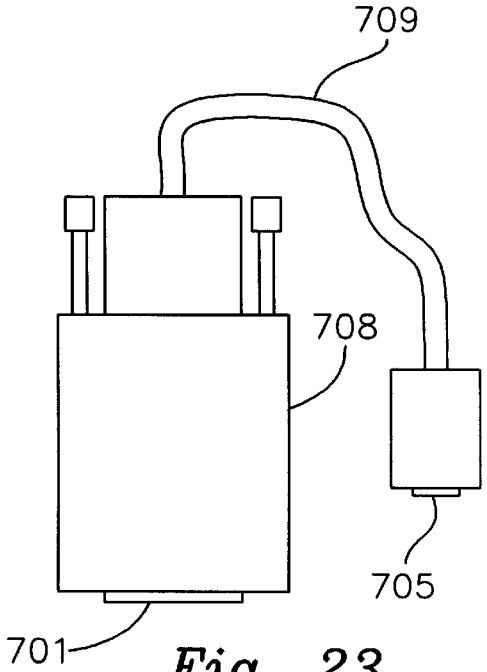
FIG. 23 is a top view of the enclosure of FIG. 21 depicting both screw-type fasteners.
Figure 24:
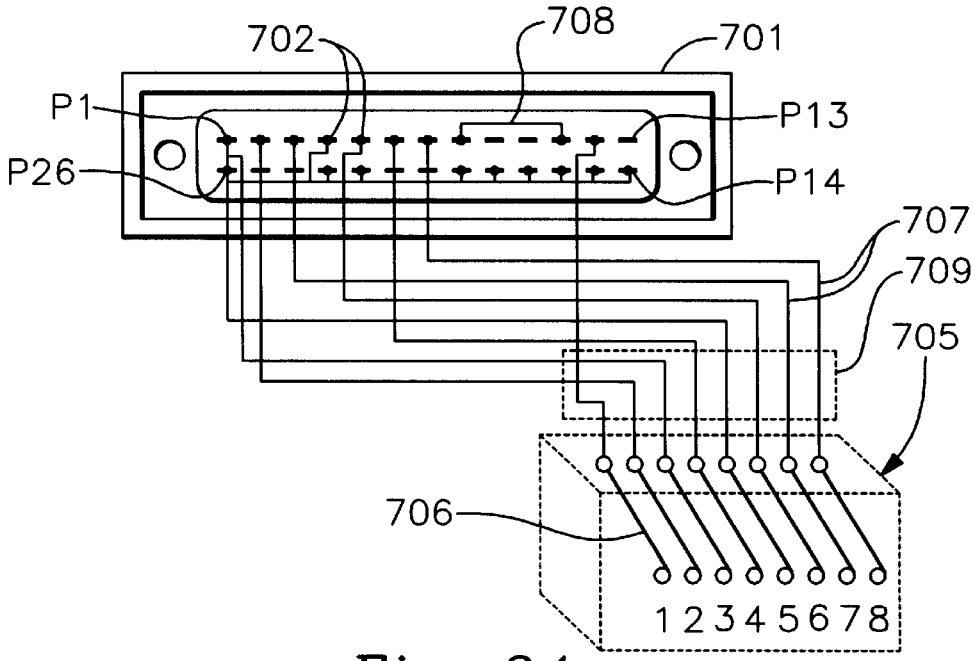
FIG. 24 is an internal wiring diagram of the connector adaptor of FIG. 21 showing the eight pin RJ45 internal leads connected to the 26 pin interface.
Figure 25:
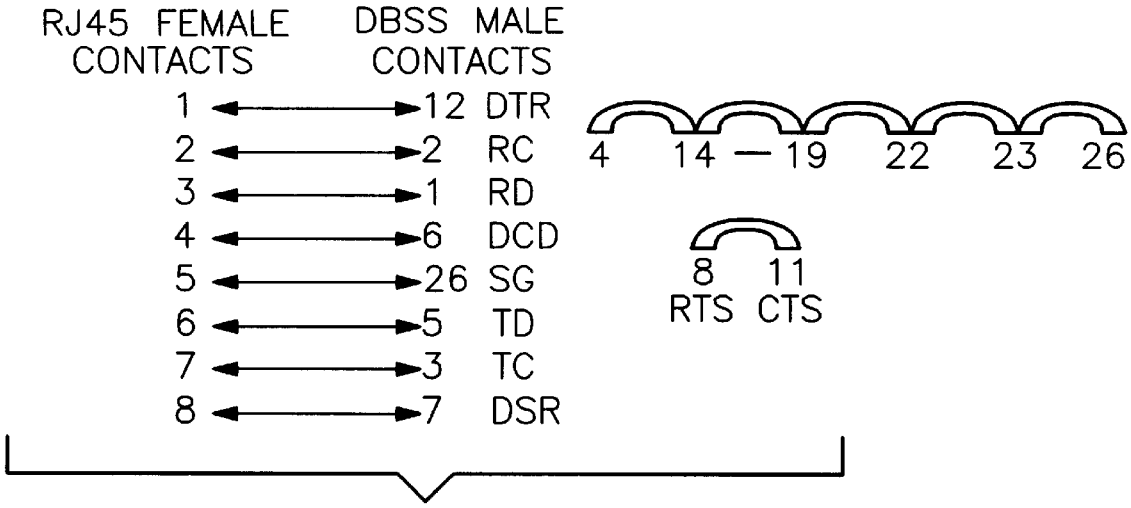
FIG. 25 is a Pinout diagram showing the designated signals as carried by the connections and loops of the wiring diagram of FIG. 24.

FIGS. 21 through 25 show an alternative embodiment designated herein as ADA-DBSSRS232MC-GM, which has an equipment interface 701 with 26 contacts or pins 702 equivalent to a Smart Serial 26 Pin Male Connector, which interface is connected to a RJ45 Female Connector, and is for use with DCE. FIG. 21 shows the 26 pin equipment interface 701 used to mate with the interface on the DCE. FIGS. 22 and 23 show a housing 703 with standard screw type fasteners 104, which is linked by cable 709 to a RJ45 connector 705. FIG. 24 illustrates a wiring diagram for this embodiment, where the RJ45 connector interface 705 comprises metallic contacts 706 pointing downward, metallic insulated conductors or leads 707, which could alternatively comprise a circuit board, joined in electrical communication through cable 709 to the internal soldering contact points of the pins 702 of the equipment interface 701. As viewed the contacts are numbered from left to right, one through eight, with one being the far left contact, and eight being the far right contact, all in accordance with 4-pair Unshielded Twisted Pair cabling standards.

Pins 9, 10, 13, 20, 21, 24 and 25 of this equipment interface 701 are not used. The Pinouts for this embodiment are shown in both FIG. 24 and FIG. 25. Pins 4, 14, 15, 16, 17, 18, 19, 22 and are shorted to 26 for Zero voltage reference, i.e., linked directly to each other, via conductive material or wiring 708. Pins 8 for Request to Send (RTS) signal and 11 for Clear to Send (CTS) signal are shorted together as well.

Contact one of RJ45 female connector 705 is connected to pin 12 of equipment interface 701 for Data Terminal Ready (DTR) signal exchange. Contact two is connected to pin 2 of equipment interface 701 for Receive Clock (RC) signal exchange. Contact three is connected to pin 1 of equipment interface 701 for Receive Data (RD) signal exchange. Contact four is connected to pin 6 of equipment interface 701 for Data Carrier Detect (DCD) signal exchange. Contact five is connected to pin 26 of equipment interface 701 for Signal Ground (SG) signal exchange. Contact six is connected to pin 5 of equipment interface 701 for Transmit Data (TD) signal exchange. Contact seven is connected to pin 3 of equipment interface 701 for Transmit Clock (TC) signal exchange. Contact eight is connected to pin 7 of equipment interface 701 for Data Source Ready (DSR) signal exchange.

Figure 26:
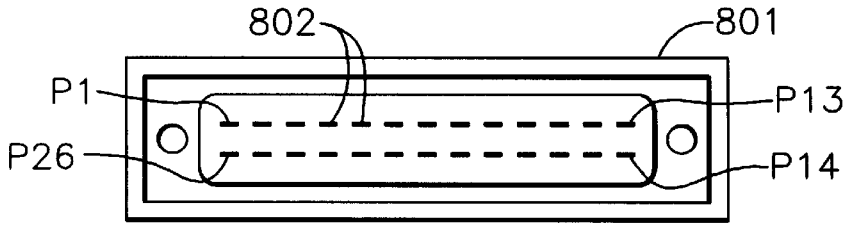
FIG. 26 is a front view of a eighth embodiment of the invention designated as an ADA-DBSSRS232MT-GM connector for DTE showing an interface equivalent to a Smart Serial 26 pin male connector and surrounding enclosure.
Figure 27:
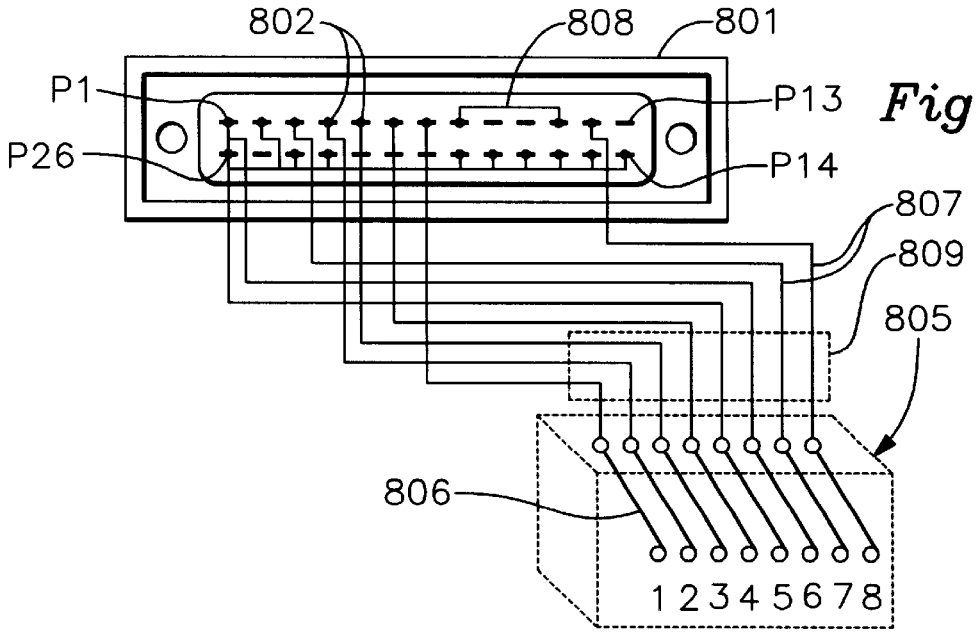
FIG. 27 is an internal wiring diagram of the connector adaptor of FIG. 26 showing the eight pin RJ45 internal leads connected to the 26 pin interface.
Figure 28:
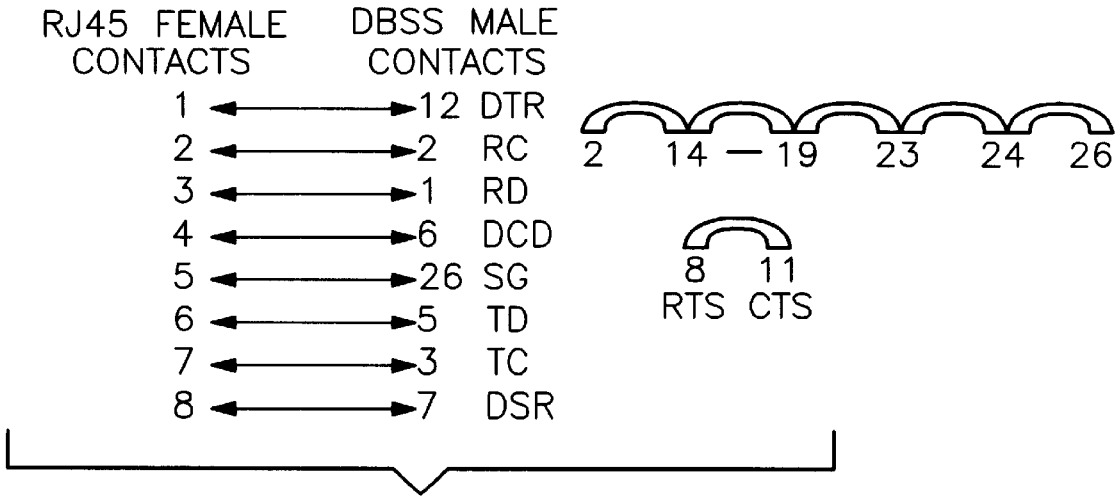
FIG. 28 is a Pinout diagram showing the designated signals as carried by the connections and loops of the wiring diagram of FIG. 27.

FIGS. 26 through 28 show an alternative embodiment designated herein as ADA-DBSSRS232MT-GM, which has an equipment interface 801 with 26 contacts or pins 802 equivalent to a Smart Serial 26 Pin Male Connector, which interface is connected to a RJ45 Female Connector, and is for use with DTE. FIG. 26 shows the 26 pin equipment interface 801 used to mate with the interface on the DTE. FIG. 27 illustrates a wiring diagram for this embodiment, where the RJ45 connector interface 805 comprises metallic contacts 806 pointing downward, metallic insulated conductors or leads 807, which could alternatively comprise a circuit board, joined in electrical communication through cable 809 to the internal soldering contact points of the pins 802 of the equipment interface 801. As viewed the contacts are numbered from left to right, one through eight, with one being the far left contact, and eight being the far right contact, all in accordance with 4-pair Unshielded Twisted Pair cabling standards.

Pins 9, 10, 13, 20–22, and 25 of this equipment interface 801 are not used. The Pinouts for this embodiment are shown in both FIG. 27 and FIG. 28. Pins 2, 14, 15, 16, 17, 18, 19, 23 and 24 are shorted to 26 for Zero voltage reference, i.e., linked directly to each other, via conductive material or wiring 808. Pins 8 for Request to Send (RTS) signal and 11 for Clear to Send (CTS) signal are shorted together as well.

Contact one of RJ45 female connector 805 is connected to pin 7 of equipment interface 801 for Data Terminal Ready (DTR) signal exchange. Contact two is connected to pin 4 of equipment interface 801 for Receive Clock (RC) signal. Contact three is connected to pin 5 of equipment interface 801 for Receive Data (RD) signal exchange. Contact four is connected to pin 6 of equipment interface 801 for Data Carrier Detect (DCD) signal exchange. Contact five is connected to pin 26 of equipment interface 801 for Signal Ground (SG) signal exchange. Contact six is connected to pin I of equipment interface 801 for Transmit Data (TD) signal exchange. Contact seven is connected to pin 3 of equipment interface 801 for Transmit Clock (TC) signal exchange. Contact eight is connected to pin 12 of equipment interface 801 for Data Source Ready (DSR) signal exchange.

Figure 29:
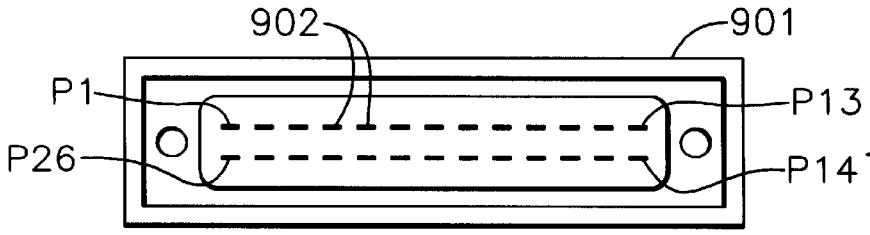
FIG. 29 is a front view of a ninth embodiment of the invention designated as an ADA-DBSSV35MC-GM connector for DCE showing an interface equivalent to a Smart Serial 26 pin male connector and surrounding enclosure.
Figure 30:
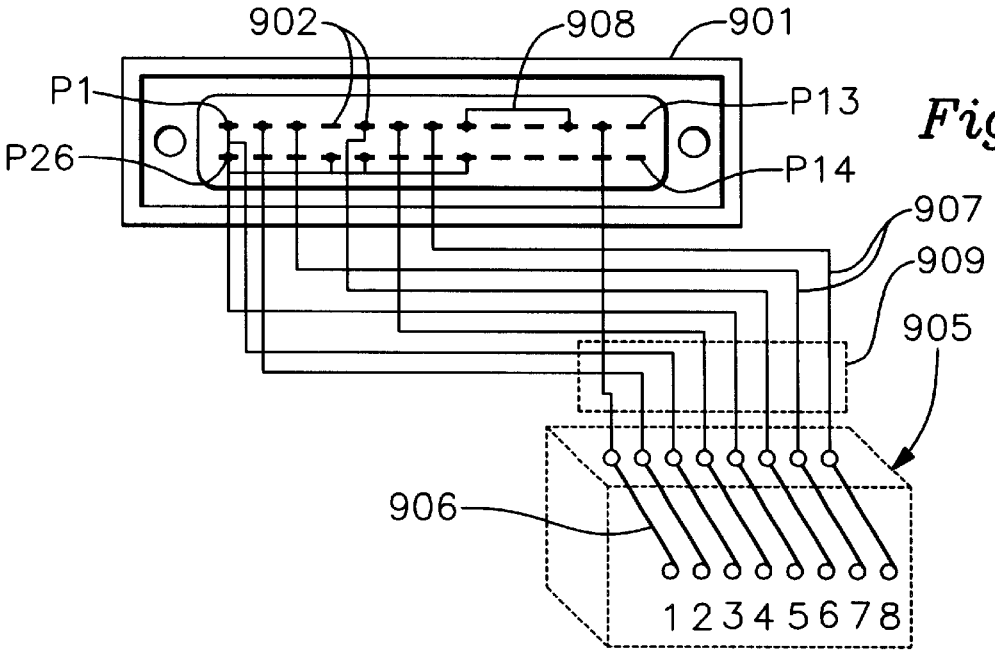
FIG. 30 is an internal wiring diagram of the connector adaptor of FIG. 29 showing the eight pin RJ45 internal leads connected to the 26 pin interface.
Figure 31:
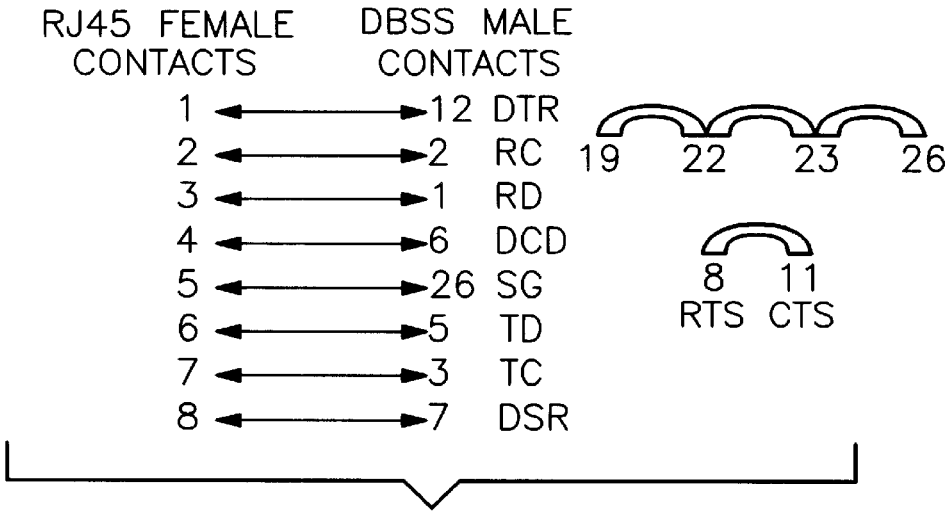
FIG. 31 is a Pinout diagram showing the designated signals as carried by the connections and loops of the wiring diagram of FIG. 30.

FIGS. 29 through 31 show an alternative embodiment designated herein as ADA-DBSSV35MC-GM, which has an equipment interface 901 with 26 contacts or pins 902 equivalent to a Smart Serial 26 Pin Male Connector, which interface is connected to a RJ45 Female Connector, and is for use with DCE. FIG. 29 shows the 26 pin equipment interface 901 used to mate with the interface on the DCE. FIG. 30 illustrates a wiring diagram for this embodiment, where the RJ45 connector interface 905 comprises metallic contacts 906 pointing downward, metallic insulated conductors or leads 907, which could alternatively comprise a circuit board, joined in electrical communication through cable 909 to the internal soldering contact points of the pins 902 of the equipment interface 901. As viewed the contacts are numbered from left to right, one through eight, with one being the far left contact, and eight being the far right contact, all in accordance with 4-pair Unshielded Twisted Pair cabling standards.

Pins 4, 9, 10, 13–18, 20, 21, 24 and 25 of this equipment interface 901 are not used. The Pinouts for this embodiment are shown in both FIG. 30 and FIG. 31. Pins 19, 22 and 23 are shorted to 26 for Zero voltage reference, i.e., linked directly to each other, via conductive material or wiring 908. Pins 8 for Request to Send (RTS) signal and 11 for Clear to Send (CTS) signal are shorted together as well.

Contact one of RJ45 female connector 905 is connected to pin 12 of equipment interface 901 for Data Terminal Ready (DTR) signal exchange. Contact two is connected to pin 2 of equipment interface 901 for Receive Clock (RC) signal exchange. Contact three is connected to pin 1 of equipment interface 901 for Receive Data (RD) signal exchange. Contact four is connected to pin 6 of equipment interface 901 for Data Carrier Detect (DCD) signal exchange. Contact five is connected to pin 26 of equipment interface 901 for Signal Ground (SG) signal exchange. Contact six is connected to pin 5 of equipment interface 901 for Transmit Data (TD) signal exchange. Contact seven is connected to pin 3 of equipment interface 901 for Transmit Clock (TC) signal exchange. Contact eight is connected to pin 7 of equipment interface 901 for Data Source Ready (DSR) signal exchange.

Figure 32:
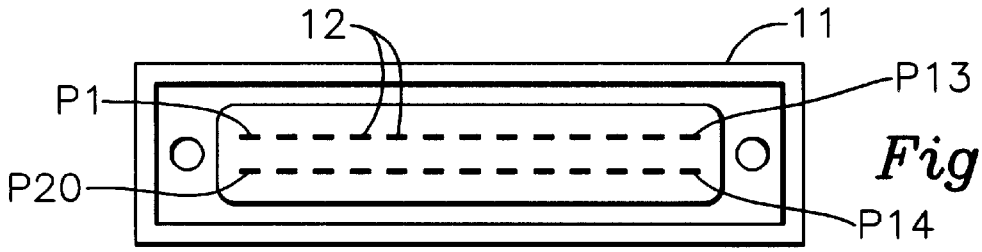
FIG. 32 is a front view of a tenth embodiment of the invention designated as an ADA-DBSSV35MT-GM connector for DTE showing an interface equivalent to a Smart Serial 26 pin male connector and surrounding enclosure.
Figure 33:
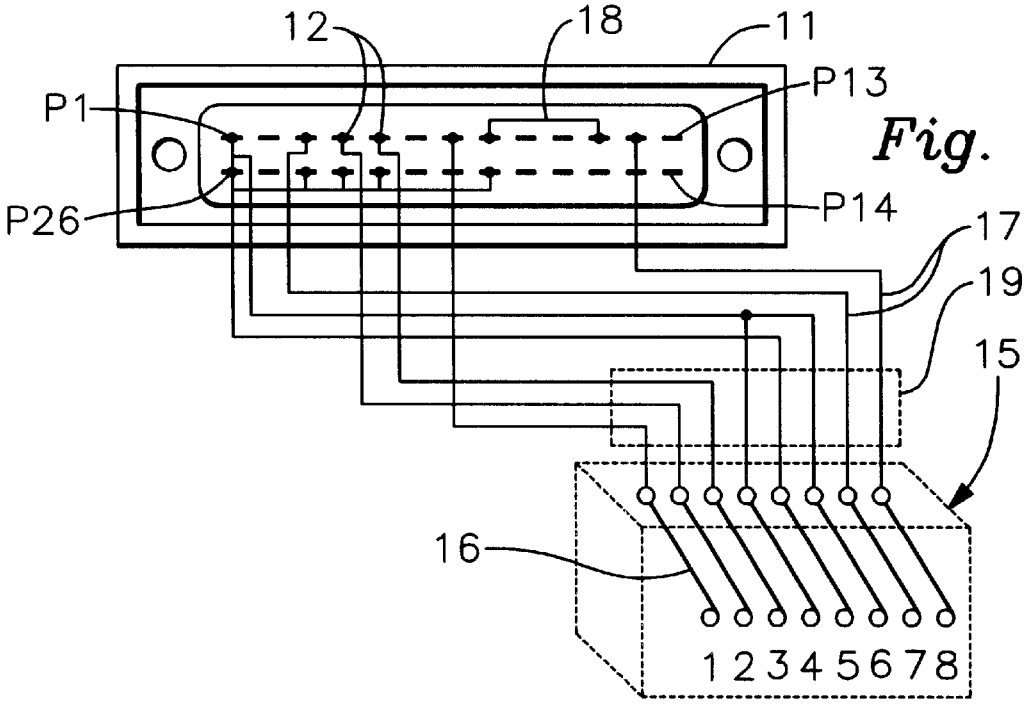
FIG. 33 is an internal wiring diagram of the connector adaptor of FIG. 32 showing the eight pin RJ45 internal leads connected to the 26 pin interface.
Figure 34:
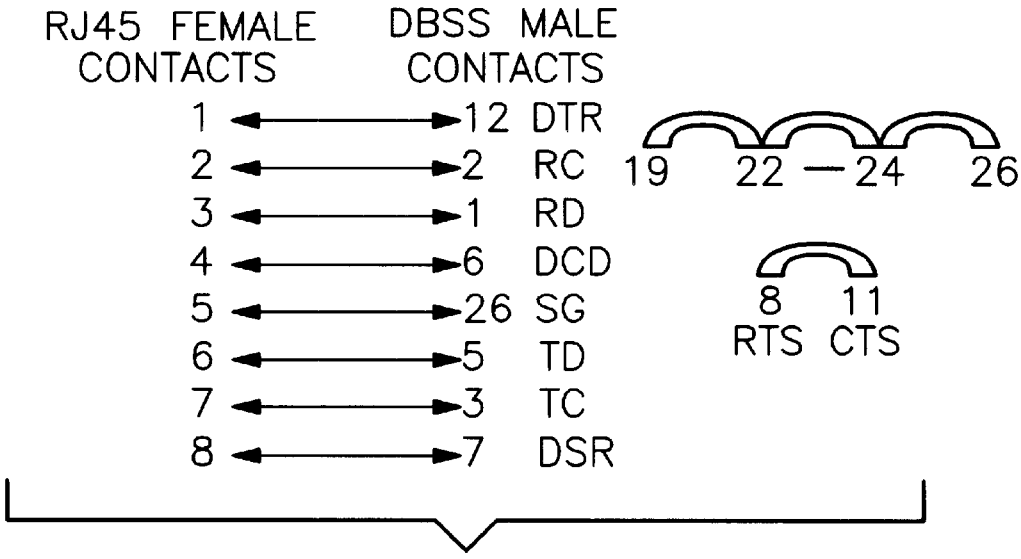
FIG. 34 is a Pinout diagram showing the designated signals as carried by the connections and loops of the wiring diagram of FIG. 33.

FIGS. 32 through 34 show an alternative embodiment designated herein as ADA-DBSSV35MT-GM, which has an equipment interface 11 with 26 contacts or pins 12 equivalent to a Smart Serial 26 Pin Male Connector, which interface is connected to a RJ45 Female Connector, and is for use with DTE. FIG. 32 shows the 26 pin equipment interface 11 used to mate with the interface on the DTE. FIG. 33 illustrates a wiring diagram for this embodiment, where the RJ45 connector interface 15 comprises metallic contacts 16 pointing downward, metallic insulated conductors or leads 17, which could alternatively comprise a circuit board, joined in electrical communication through cable 19 to the internal soldering contact points of the pins 12 of the equipment interface 11. As viewed the contacts are numbered from left to right, one through eight, with one being the far left contact, and eight being the far right contact, all in accordance with 4-pair Unshielded Twisted Pair cabling standards.

Pins 2, 6, 9, 10, 13–18, 20, 21 and 25 of this equipment interface 11 are not used. The Pinouts for this embodiment are shown in both FIG. 30 and FIG. 31. Pins 19, 22, 23 and 24 are shorted to 26 for Zero Voltage reference, i.e., linked directly to each other, via conductive material or wiring. Pins 8 for Request to Send (RTS) signal and 11 for Clear to Send (CTS) signal are shorted together as well.

Contact one of RJ45 female connector 15 is connected to pin 7 of equipment interface 11 for Data Terminal Ready (DTR) signal exchange. Contact two is connected to pin 4 of equipment interface 11 for Receive Clock (RC) signal exchange. Contact three is connected to pin 5 of equipment interface 11 for Receive Data (RD) signal exchange. Contact four is connected to pin 6 of equipment interface 11 for Data Carrier Detect (DCD) signal exchange. Contact five is connected to pin 26 of equipment interface 11 for Signal Ground (SG) signal exchange. Contact six is connected to pin 1 of equipment interface 11 for Transmit Data (TD) signal exchange. Contact seven is connected to pin 3 of equipment interface 11 for Transmit Clock (TC) signal exchange. Contact eight is connected to pin 7 of equipment interface 11 for Data Source Ready (DSR) signal exchange.

Figure 35:
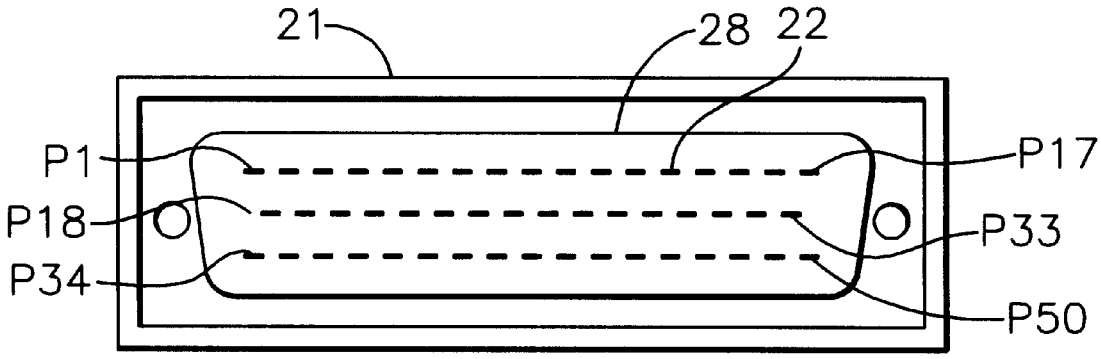
FIG. 35 is a front view of an eleventh embodiment of the invention designated as an ADA-DB50V35MC-GM connector for DCE showing an interface equivalent to a 50 pin male connector and surrounding enclosure.
Figure 36:
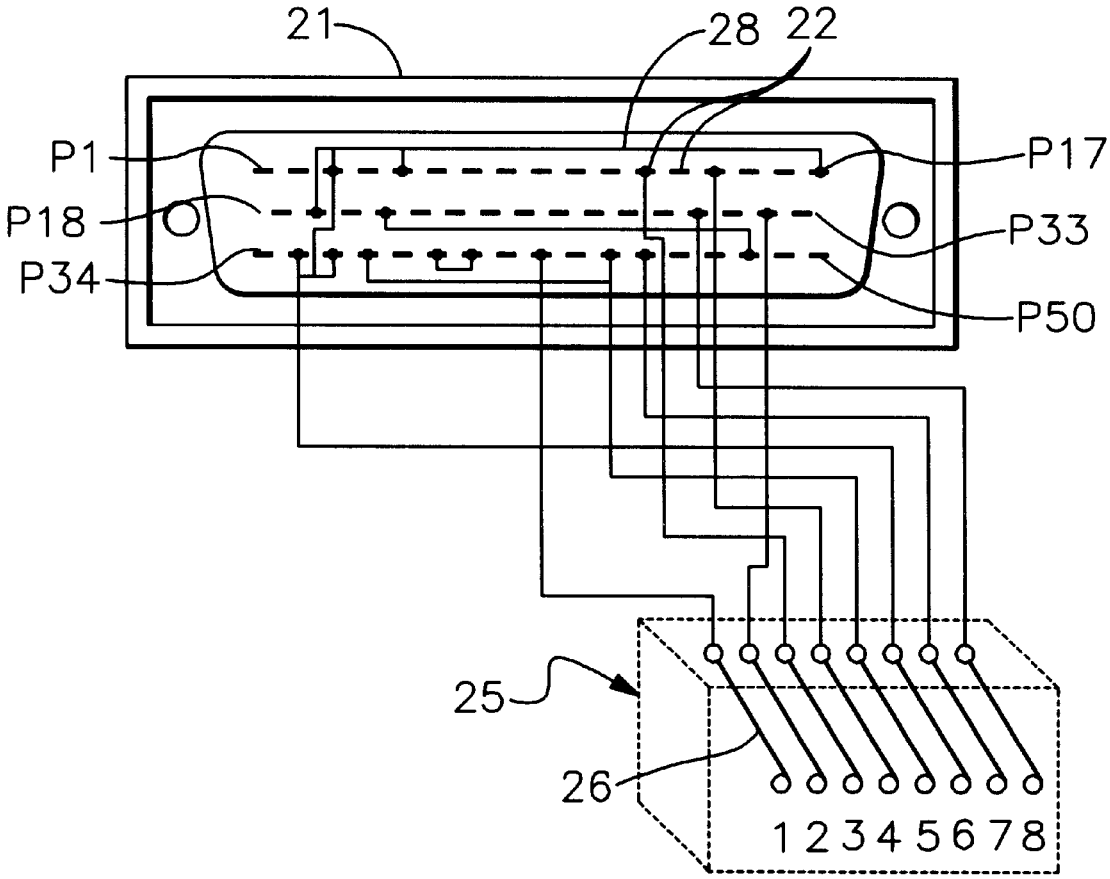
FIG. 36 is an internal wiring diagram of the connector adaptor of FIG. 35 showing the eight pin RJ45 internal leads connected to the 50 pin interface.
Figure 37:
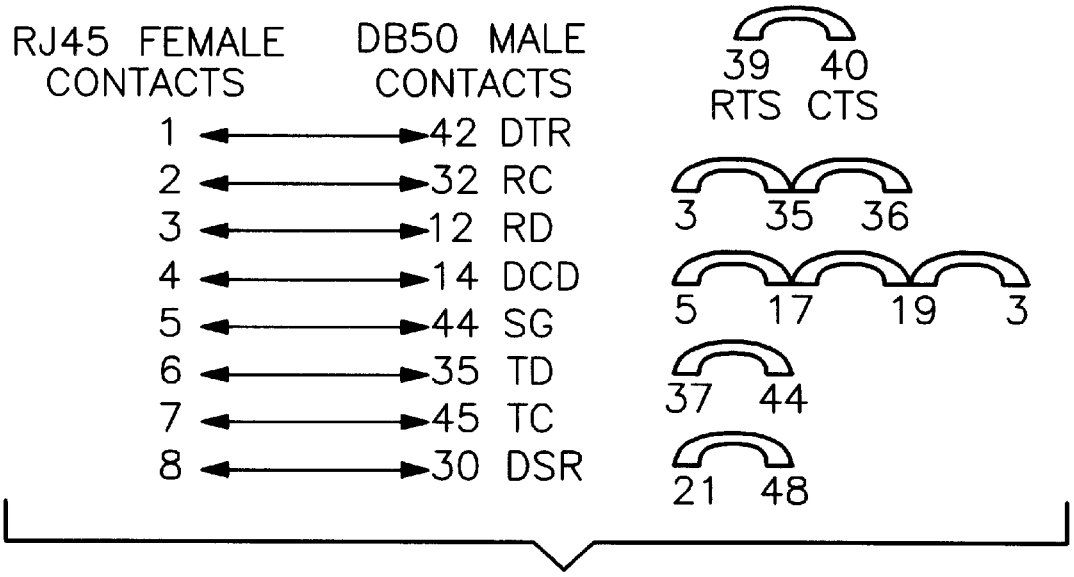
FIG. 37 is a Pinout diagram showing the designated signals as carried by the connections and loops of the wiring diagram of FIG. 36.

FIGS. 35 through 37 show an alternative embodiment designated herein as ADA-DB50V35MC-GM, which has an equipment interface 21 with 50 contacts or pins 22 equivalent to a 50 Pin Male Connector, which interface is connected to a RJ45 Female Connector, and is for use with DCE. FIG. 35 shows the 50 pin equipment interface 21 used to mate with the interface on the DCE. FIG. 36 illustrates a wiring diagram for this embodiment, where the RJ45 connector interface 25 comprises metallic contacts 26 pointing downward, metallic insulated conductors or leads 27, which could alternatively comprise a circuit board, joined in electrical communication to the internal soldering contact points of the pins 22 of the equipment interface 21. As viewed the contacts are numbered from left to right, one through eight, with one being the far left contact, and eight being the far right contact, all in accordance with 4-pair Unshielded Twisted Pair cabling standards.

Pins 1, 2, 4, 6–11, 13, 15, 16, 18, 20, 22–29, 31, 33, 34, 41, 43, 46, 47 and 49 of this equipment interface 21 are not used. The Pinouts for this embodiment are shown in both FIG. 36 and FIG. 37. Pins 39 for Request to Send (RTS) signal and 40 for Clear to Send (CTS) signal are shorted, i.e., linked directly to each other, via conductive material or wiring 18. Pins 3, 35 and 36 are linked. Pins 5, 17, 19 and 38 are linked. Pins 37 and 44 are linked. Pins 21 and 48 are linked as well.

Contact one of RJ45 female connector 25 is connected to pin 42 of equipment interface 21 for Data Terminal Ready (DTR) signal exchange. Contact two is connected to pin 32 of equipment interface 21 for Receive Clock (RC) signal exchange. Contact three is connected to pin 12 of equipment interface 21 for Receive Data (RD) signal exchange. Contact four is connected to pin 14 of equipment interface 21 for Data Carrier Detect (DCD) signal exchange. Contact five is connected to pin 44 of equipment interface 21 for Signal Ground (SG) signal exchange. Contact six is connected to pin 35 of equipment interface 21 for Transmit Data (TD) signal exchange. Contact seven is connected to pin 45 of equipment interface 21 for Transmit Clock (TC) signal exchange. Contact eight is connected to pin 30 of equipment interface 21 for Data Source Ready (DSR) signal exchange.

Figure 38:
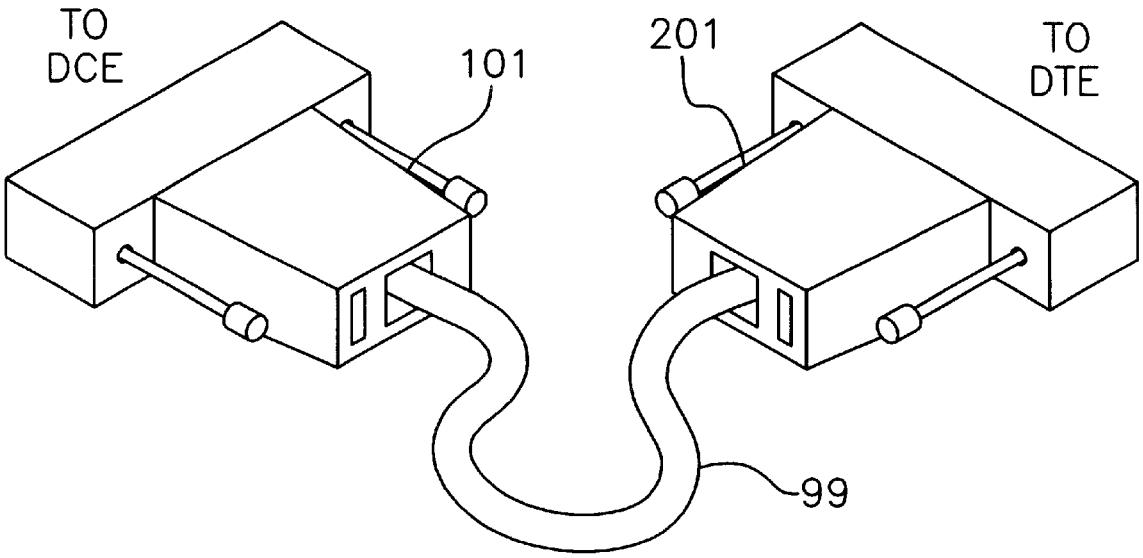
FIG. 38 illustrates a representative DTE adaptor connector and a representative DCE adaptor connector joined by a 4-pair CAT-5 UTP cable.

FIG. 38 illustrates a pair of connector adaptor devices 101 and 201 as described herein linked in electrical communication by a 4-pair CAT-5 UTP cable 99, where one connector adaptor is to be joined to DCE and the other to DTE. Other adaptor pairings would be accomplished in the same manner dependent on the particular DCE and DTE. Although the connector adaptors and the combination with cable have been defined using detachable RJ45 type connections, it is to be understood that the cable containing eight lead wires could be hardwired directly to the connector adaptors without departing from the spirit of the invention.

It is understood that equivalents and substitutions to certain elements set forth above may be obvious to those skilled in the art, and therefore the true scope and definition of the invention is to be as set forth in the following claims.

We claim:

1. A connector adapter for enabling synchronous serial data transmissions between DTE (data terminal equipment) and DCE (data communications equipment) over eight wires within unshielded twisted pair cable, said connector adapter comprising:

an equipment interface having at least n pins, n being a number greater than eight, wherein one of said at least n equipment interface pins is a RTS (request-to-send) pin, and another one of said at least n equipment interface pins is a CTS (clear-to-send) pin and are adapted to transport n signals utilized by the DTE or the DCE during EIA/TIA-232 (Electronic-Industry-Alliance/Telecommunication-Industry-Association-232) synchronous serial communication;

a RJ45 type connector interface having eight contacts each fixedly wired within said connector adapter to one of eight of the n equipment interface pins adapted to transport the n signals utilized by the DTE or DCE during EIA/TIA-232 synchronous serial communication;

wherein the RTS pin is fixedly wired within the connector adapter to the CTS pin such that synchronous serial data communications may be transported across said connector adapter utilizing the eight equipment interface pins fixedly wired to the eight RJ45 type connector interface contacts.

2. The connector adaptor of claim 1, wherein the wiring interconnectivity between said equipment interface and said RJ45 type connector interface is encased within a connector adapter housing.

3. The connector adaptor of claim 1, wherein said equipment interface is an equipment interface chosen from the group of equipment interfaces consisting of a 60 pin equipment interface, a 50 pin equipment interface, a 26 pin equipment interface and a 25 pin equipment interface.

4. The connector adaptor of claim 1, wherein the n equipment interface pins adapted to transport n signals utilized by the DTE or DCE during EIA/TIA- 232synchronous serial communications include a data terminal ready pin, a data source ready pin, a transmit clock pin, a receive clock pin, a transmit data pin, a receive data pin, a data carrier detect pin, a request-to-send pin, a clear-to-send pin, and a signal ground pin, and wherein the eight equipment interface pins fixedly wired to the eight RJ45 type connector interface contacts include the data terminal ready pin, the data source ready pin, the transmit clock pin, the receive clock pin, the transmit data pin, the receive data pin, the data carrier detect pin, and the signal ground pin.

5. The connector adaptor of claim 2, wherein said equipment interface is exposed from an equipment end of the connector adapter housing and said RJ45 type connector interface is exposed from an opposing cable end of said connector adapter housing.

6. The connector adaptor of claim 5, wherein said unshielded twisted pair cable is a 4-pair Category-5 unshielded twisted pair cable joined to said connector adaptor housing through said RJ45 type connector interface.

* * * * *